US008371484B2

(12) United States Patent
Keller et al.

(10) Patent No.: US 8,371,484 B2
(45) Date of Patent: Feb. 12, 2013

(54) SLIDING CLOSURE FOR A VESSEL CONTAINING MOLTEN METAL

(75) Inventors: Werner Keller, Steinhausen (CH); Benno Steiner, Nebikon (CH)

(73) Assignee: Stopinc Aktiengesellschaft, Hunenberg (CH)

( * ) Notice: Subject to any disclaimer, the term of this patent is extended or adjusted under 35 U.S.C. 154(b) by 415 days.

(21) Appl. No.: 12/669,085

(22) PCT Filed: Jun. 23, 2008

(86) PCT No.: PCT/EP2008/005039

§ 371 (c)(1),
(2), (4) Date: Jan. 14, 2010

(87) PCT Pub. No.: WO2009/010153

PCT Pub. Date: Jan. 22, 2009

(65) Prior Publication Data

US 2010/0199566 A1 Aug. 12, 2010

(30) Foreign Application Priority Data

Jul. 16, 2007 (CH) ..... 1170/07

(51) Int. Cl.
*E05F 11/02* (2006.01)

(52) U.S. Cl. ..... 222/600

(58) Field of Classification Search ..... 49/139, 49/140, 324, 356, 449; 292/252, 137, 150, 292/302; 222/600
See application file for complete search history.

(56) References Cited

U.S. PATENT DOCUMENTS

| | | | | |
|---|---|---|---|---|
| 4,042,207 | A * | 8/1977 | Nehrlich et al. | 222/600 |
| 4,601,416 | A | 7/1986 | Schiltknecht et al. | |
| 4,658,994 | A | 4/1987 | Fricker | |
| 4,728,014 | A | 3/1988 | Keller | |
| 5,429,342 | A | 7/1995 | Pfyl et al. | |
| 5,698,129 | A | 12/1997 | Keller et al. | |
| 5,961,873 | A | 10/1999 | Keller | |
| 6,045,015 | A | 4/2000 | Waltenspuehl et al. | |
| 7,383,972 | B2 | 6/2008 | Keller | |
| 2010/0017027 | A1 | 1/2010 | Truttmann | |
| 2010/0147905 | A1 | 6/2010 | Keller | |
| 2011/0127265 | A1 | 6/2011 | Steiner et al. | |
| 2011/0127302 | A1 | 6/2011 | Steiner et al. | |

* cited by examiner

*Primary Examiner* — Scott Kastler
(74) *Attorney, Agent, or Firm* — Brian Roffe

(57) ABSTRACT

A sliding closure for a vessel containing molten metal, having a slider unit guided in a slider housing, the slider unit having a push rod that can be connected to a drive rod of a linear drive via a coupling, wherein a mounting element for the linear drive is provided on the slider housing and receives the push rod and the drive rod on a coupling side. The mounting element is equipped with an automatically operating locking device for the linear drive. The slide closure operates reliably, both during the casting process and during transport thereof between the various stations of the plant.

20 Claims, 6 Drawing Sheets

SLIDING CLOSURE FOR A VESSEL CONTAINING MOLTEN METAL

FIELD OF THE INVENTION

The invention relates to a sliding closure for a vessel containing molten metal, having a slider unit guided in a slider housing, said slider unit having a push rod that can be connected to the drive rod of a linear drive via a coupling, wherein a mounting element for the linear drive is provided on the slider housing, said element receiving the push rod and the drive rod on the coupling side.

BACKGROUND OF THE INVENTION

Slide closures of this type are used, for example, for the continuous casting of steel in order during the casting process to steer the molten flow flowing out of the vessel and, if necessary, to interrupt it. Here it is known that the vessel must periodically be moved to and fro between the casting platform and the plant supplying the molten mass. In order to accelerate the operational procedures linear drives are provided in both stations. Here the latter are respectively pushed into the mounting element of the sliding closure where their drive rod is then coupled to the push rod of the slider unit. In European patent specification EP 0 875 320 a coupling provided for this purpose is described which facilitates the fitting and removal of the linear drive and simplifies the coupling processes.

However, with the known sliding closures of this type there is a risk that during operation, due to the rough method of operation or incorrect handling, the linear drive comes away from its mounting element and so causes severe disruption to the casting operation.

A similar thing can occur with the periodic transport of the vessel between the different stations of the plant. That is to say, there is then a risk that the sliding closure opens unintentionally if it is handled incorrectly during transport. In both cases the consequences are serious, both from a commercial point of view and with regard to the safety of the people employed here.

OBJECTS AND SUMMARY OF THE INVENTION

The object which forms the basis of the invention is to avoid these disadvantages and to provide a sliding closure of the type specified at the start which guarantees a high degree of operational reliability even with the rough operation which is normal at casting plants.

This object is achieved according to the invention in that the mounting element is equipped with a locking device for the linear drive and/or a locking device for the push rod of the slider unit.

In this way, on the one hand it is ensured that the linear drive is held correctly in the mounting element after said linear drive has been drawn into the latter until the sliding closure leaves the one station in order to change over to the other station. On the other hand, it is also ensured that the sliding closure does not open unintentionally during transport from one station to the other.

Furthermore, the invention makes provision such that the locking device for the linear drive has a locking rod attached to it parallel to the axis on the drive rod and which cooperates with a spring-loaded locking catch attached to the mounting element. In the fitted state the latter encompasses the locking rod sliding therein over the whole stroke length of the drive and so causes the latter to sit securely in the mounting element for as long as it is fitted in the latter.

It is advantageous within the context of a simple design for the locking rod to be attached to a flange of the drive rod in the region of its coupling part.

According to the invention the locking rod has on the coupling side a recess which when the drive rod is drawn in can engage with the locking catch and afterwards can be released again from the locking catch. The locking and unlocking of the linear drive takes place automatically when the latter is drawn in and out with the drive rod drawn in.

Advantageously the locking rod has on its end facing away from the coupling a further recess which can be released from the locking catch when the drive rod is drawn out. Here the unlocking of the linear drive also takes place automatically when the latter is drawn out with the drive rod drawn out.

The invention also makes provision such that the locking catch is mounted laterally to the locking rod in a bolt guided within the mounting element, it advantageously being able to be spread open by turning or moving the bolt. Therefore, by operating the bolt the locking of the linear drive can be released at any time as required.

Furthermore, according to the invention provision is made such that the locking device has for the push rod of the slider unit a spring-loaded lever pivotably mounted in the mounting element which is provided with a detent disposed close to the pivot axis and a blocking pin disposed on the lever end facing away from the pivot axis, the detent and the blocking pin projecting into the mounting element and cooperating here with the coupling part of the drive rod or with a stop surface of the push rod. When the linear drive is drawn out of the mounting element the detent, and so the blocking pin, are automatically pivoted inwards by means of which the push rod is locked with the blocking pin. In this way one prevents the sliding closure from opening unintentionally during subsequent transport within the plant.

Alternatively, the locking device for the push rod can have two detents projecting into the mounting element and which are connected to one another by means of a connecting rod rotatably mounted in the mounting element, and which cooperate with stop surfaces of the linear drive and of the push rod which are advantageously formed by a stroke limitation bolt disposed laterally to the latter in the push rod and by a supporting plate of the linear drive that can be pushed into the mounting element. Upon drawing the linear drive into the mounting element the two detents are pivoted outwards and the push rod can move freely within the mounting element. If the linear drive is drawn out, both detents then pivot inwards again to such an extent that the push rod is locked by the detent cooperating with its stop surface.

BRIEF DESCRIPTION OF THE DRAWINGS

In the following the invention is described in greater detail by means of a number of exemplary embodiments with reference to the drawings. These show as follows.

DETAILED DESCRIPTION OF THE INVENTION

Figure 1:
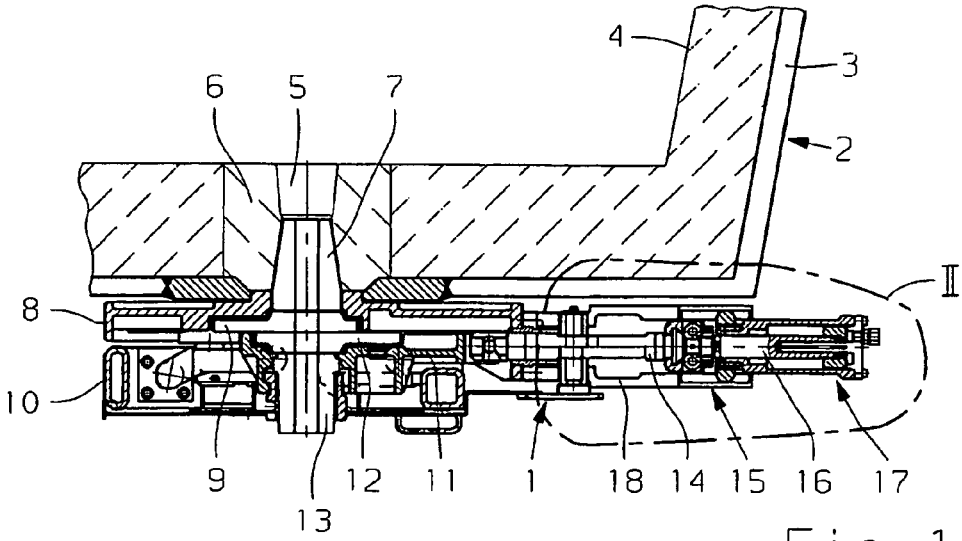
FIG. 1 is a longitudinal section of a sliding closure according to the invention.

FIG. 1 shows a sliding closure 1 on a vessel containing molten metal which is shown in the figure partially as a ladle 2. The ladle 2 has an outer steel coating 3, a fire-resistant lining 4 and an outlet 5 which is formed by a fire-resistant perforated brick 6 and a fire-resistant casing 7. Disposed on the outlet 5 is the sliding closure 1 comprising a housing upper part 8 with a fire-resistant base plate 9 inserted in the latter, a housing frame 10 and a slider unit 11 braced releaseably within the latter, having a fire-resistant slider plate 12 and a discharge casing 13 adjacent to the latter. By moving the slider unit 11 and the slider plate 12 inserted within the latter longitudinally, the outlet 5 can be brought from the opening position illustrated into a restricting or closure position.

In order to move the slider unit 11 to and fro the latter can be connected via a push rod 14 and a coupling 15 to the drive rod 16 of a linear drive 17 in the form of a hydraulic cylinder/piston unit. The linear drive 17 is generally fitted onto the ladle 2 filled with molten metal and equipped with the closed sliding closure 1 when said ladle is brought onto the casting platform. After emptying the ladle the linear drive 17 is taken away from the ladle again. Next the ladle is transported by a crane away from the casting platform to a ladle location. Here the process described is repeated with a drive positioned at the ladle location.

Figure 2:
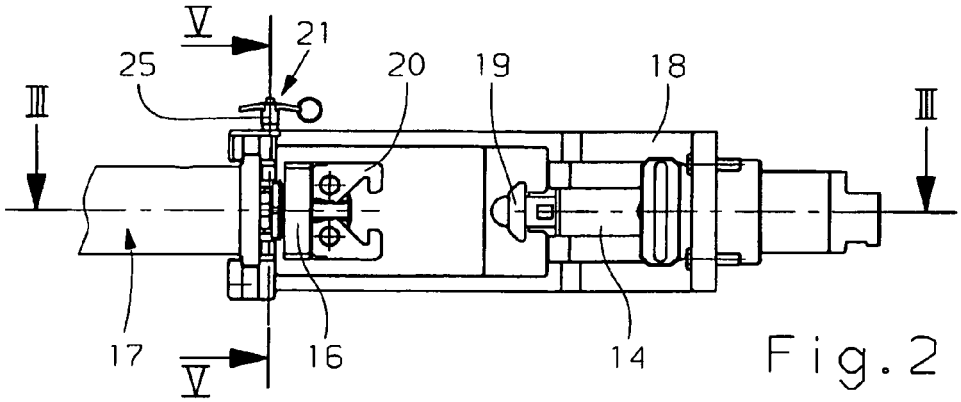
FIG. 2 is detail II from FIG. 1 with a cylinder lock for the linear drive in the uncoupled state, rotated about 180° and shown in enlarged form.
Figure 3:
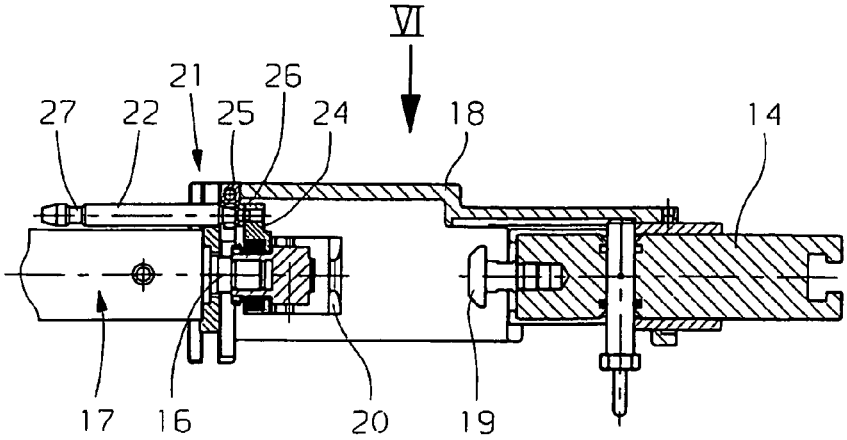
FIG. 3 is a section along line III-III in FIG. 2.
Figure 4:
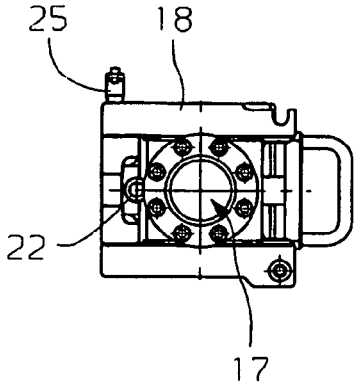
FIG. 4 is a side view of detail II from FIG. 1.
Figure 5:
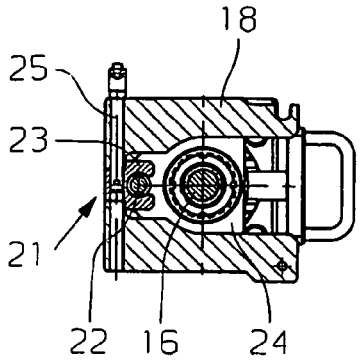
FIG. 5 is a section along line V-V in FIG. 2.
Figure 6:
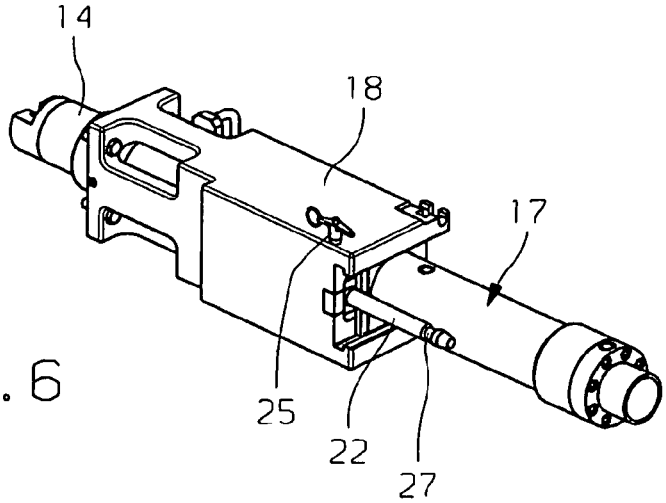
FIG. 6 is a side view in the direction of arrow VI in FIG. 3, shown in perspective.
Figure 7:
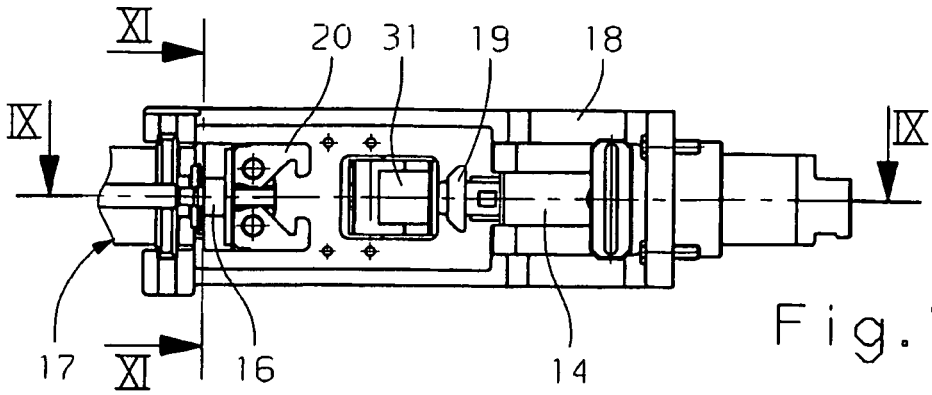
FIG. 7 is detail II from FIG. 1 with a transport lock for the push rod of the slider unit, also in the uncoupled state, rotated about 180° and shown in enlarged form.
Figure 8:
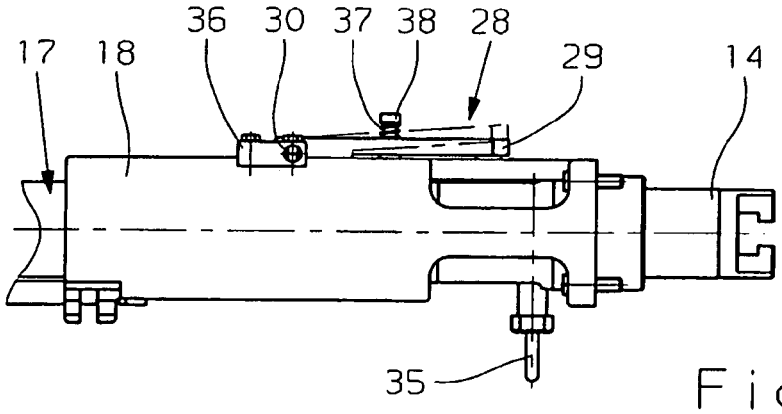
FIG. 8 is a top view of the detail from FIG. 7.

On the slider housing 8, 10 a mounting element 18 receiving the push rod 14 and the drive rod 16 on the coupling side is provided for the linear drive 17. The coupling 15 located here is in the form of a catch coupling. As can be seen from FIG. 2 it comprises a flange-type coupling part 19 on the push rod 14 and a coupling part 20 formed by two catch elements on the drive rod 16, in the coupled state the catch elements encompassing the coupling part 19 with a form fit. The linear drive 17 is pushed into the mounting element 18 on the side. Then the coupling is produced automatically by moving the drive rod 16 towards the slider unit 11. Uncoupling likewise takes place automatically when one pulls the linear drive 17 out of the mounting element 18.

Disposed in the mounting element 18 there is a locking device 21 for the linear drive 27 which, as can be seen from FIGS. 2 to 6, is composed of a locking rod 22 and a locking catch 23 cooperating with the latter. The locking rod 22 is attached to a flange 24 of the drive rod 16 in the region of its coupling part 20. It is aligned axially parallel to the drive rod 16.

The locking catch 23 is mounted laterally to the locking rod 22 in a bolt 25 which is guided within the mounting element 18. Its two catch elements are thus held by the bolt 25. By taking away the bolt 25, if so required the catch elements can be released from the mounting element, by means of which the locking of the linear drive is cancelled.

The locking rod 22 has two recesses in the form of annular grooves 26, 27 which correspond to the stroke end positions of the drive rod 16. The diameter of the annular groove 26 has dimensions such that upon inserting the linear drive 17 in the mounting element 18 with a drawn in drive rod the annular groove 26 can engage with the locking catch 23, whereas when the linear drive 17 is drawn out it can be released from the locking catch 23.

When moving the drive rod 16 the locking rod 22 is also moved, the locking catch 23 encompassing the latter in the region between the annular grooves 26, 27 so strongly that it is then impossible to release the locking rod 22 from the locking catch 23 laterally to its longitudinal axis. Therefore, during its whole working stroke the linear drive 17 remains securely locked, and so automatically acting locking and unlocking is produced which takes place without any manual operation.

The diameter of the annular groove 27 has dimensions such that it can be released from the locking catch 23 when the linear drive 17 is drawn out of the mounting element 18. It is therefore possible, if so required, to remove the linear drive, even when the drive rod 16 is drawn out. Furthermore, the locking rod 22 serves to prevent the drive rod 16 from rotating.

The sliding closure according to FIGS. 7 to 13 is equipped with a locking device 28 for the push rod 14. It comprises a lever 29 mounted pivotably in the mounting element 18 with a tappet 31 close to the pivot axis 30 and a blocking pin 32 on the lever end facing away from the pivot axis, the tappet 31 and the blocking pin 32 projecting into the mounting element 18 and cooperating here with the coupling part 20 of the drive rod 16 and with a stop surface 33 of the push rod 14. A stroke limitation bolt 34 with a handle 35 pushed into the push rod 14 laterally to the longitudinal axis forms the stop surface 33.

The pivot axis 30 of the lever 29 sits in a bearing block 36 which is attached to the mounting element 18. The lever 29 is acted upon by a spring 37 with an adjustment screw 38 in the inwardly pivoting direction.

Figure 9:
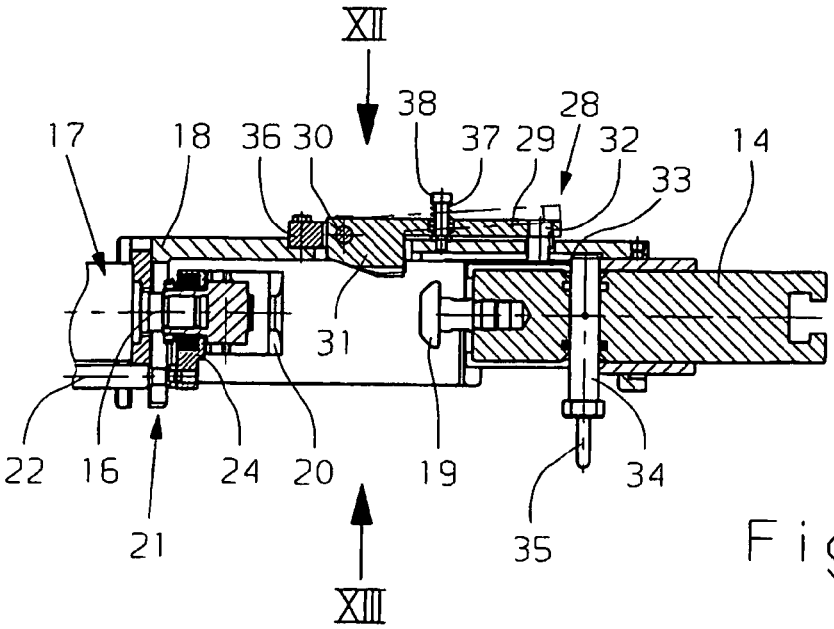
FIG. 9 is a section along line IX-IX in FIG. 7.
Figure 10:
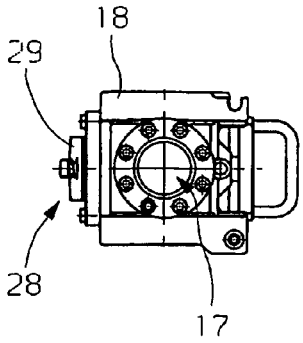
FIG. 10 is a side view of the detail from FIG. 7.
Figure 11:
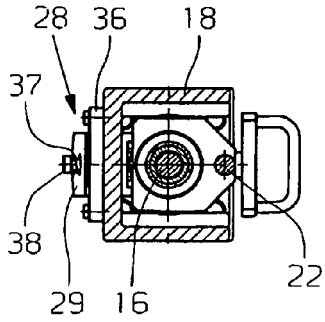
FIG. 11 is a section along line XI-XI in FIG. 7.
Figure 12:
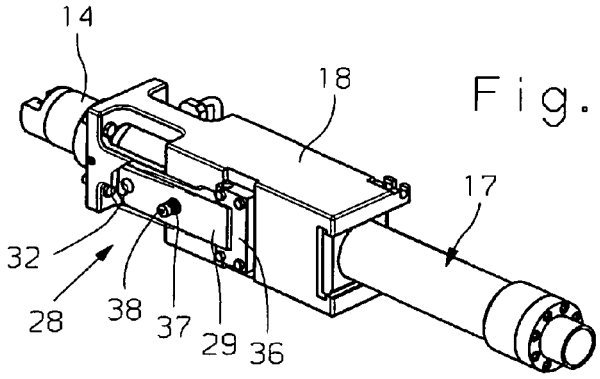
FIG. 12 is a side view in the direction of arrow XII in FIG. 9, shown in perspective.
Figure 13:
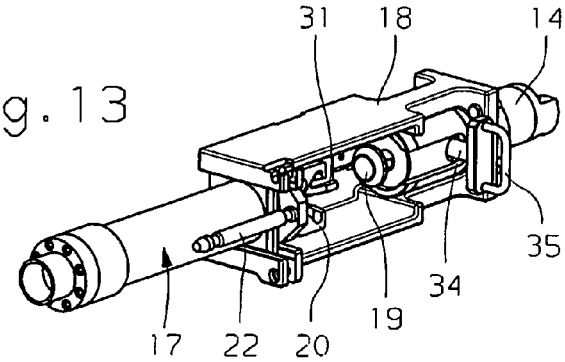
FIG. 13 is a side view in the direction of arrow XIII in FIG. 9, also shown in perspective.
Figure 14:
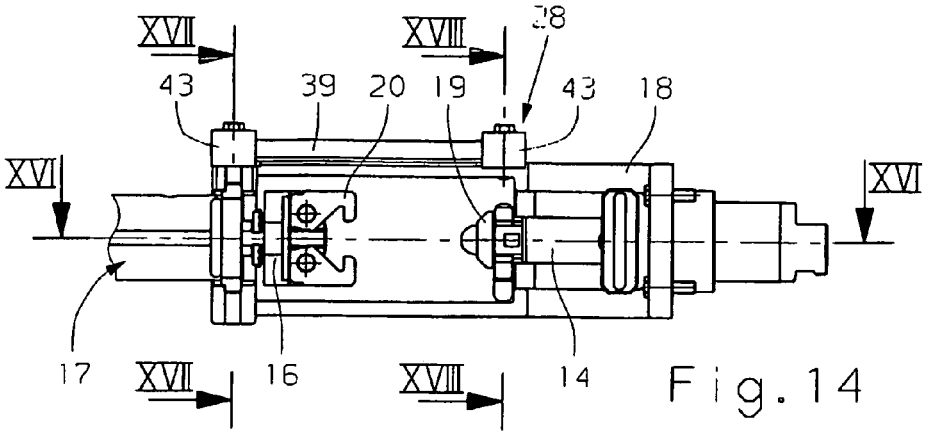
FIG. 14 is detail II from FIG. 1 with a version of the transport lock, also rotated about 180° and shown in enlarged form.
Figure 15:
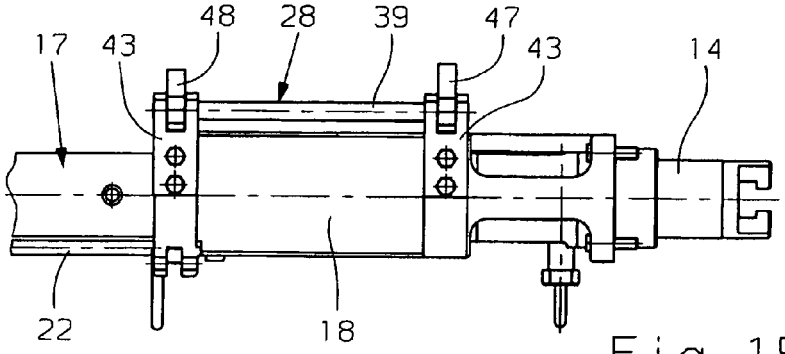
FIG. 15 is a top view of the detail from FIG. 14.
Figure 16:
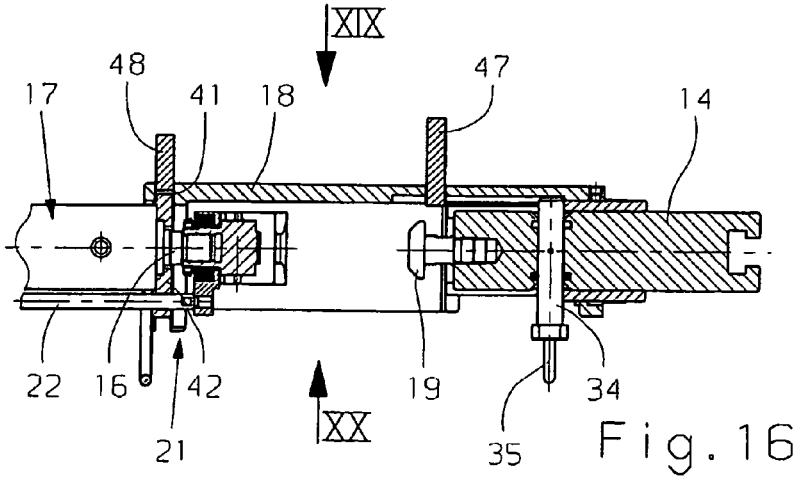
FIG. 16 is a section along line XVI-XVI in FIG. 14.
Figure 17:
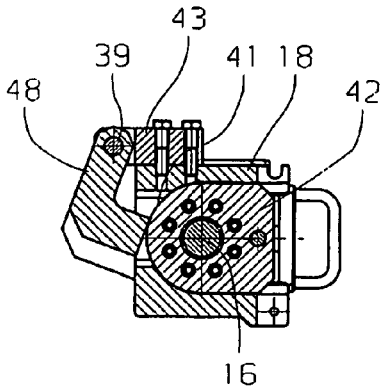
FIG. 17 is a section along line XVII-XVII in FIG. 14.
Figure 18:
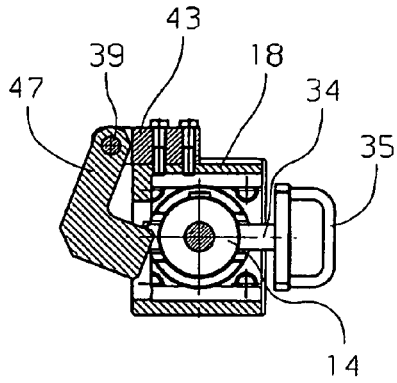
FIG. 18 is a section along line XVIII-XVIII in FIG. 14.
Figure 19:
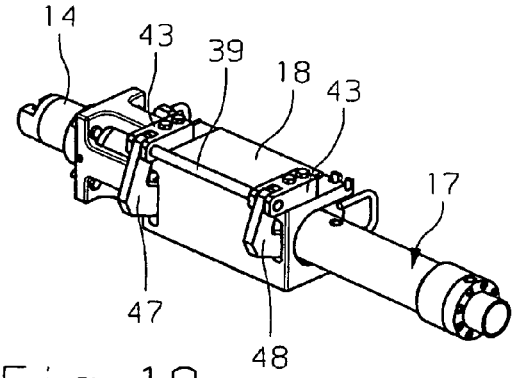
FIG. 19 is a side view in the direction of arrow XIX in FIG. 16, shown in perspective.
Figure 20:
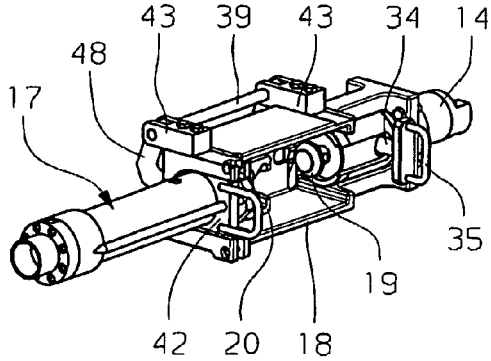
FIG. 20 is a side view in the direction of arrow XX in FIG. 16, also shown in perspective.

FIG. 9 shows the locking device 28 with the lever 29 pivoted in. In the position shown the drive rod 16 is drawn in, whereas the push rod 14 adopts its end position with the slider closed. In order to couple the drive rod 16 onto the push rod the former is drawn out within the mounting element 18 until the coupling is produced between the two. It thus actuates the tappet 31, by means of which the lever 29 is pivoted out, and the latter takes the blocking pin 32 out of the trajectory of the stroke limitation bolt 34. The push rod 14 can therefore move freely within its working stroke for as long as the drive rod 16 and the push rod 14 are coupled.

If, however, the coupling is released again and the drive rod 16 drawn back, the tappet 31 can then pivot back into its initial position, by means of which the spring-loaded lever 29 pivots back and the blocking pin 32 projects once again into the trajectory of the stroke limitation bolt 34. In this way it is ensured that after the linear drive 17 has been dismantled, the sliding closure does not open unintentionally because then the push rod 14 is locked by the blocking pin 32. With this locking device 28 automatically acting locking and unlocking has in turn been produced.

With the sliding closure according to FIGS. 14 to 20 the locking device 28 for the push rod 14 has two detents 47, 48 projecting into the mounting element 18 which are connected to one another by a connecting rod 39 rotatably mounted in bearing blocks 43, and cooperate with stop surfaces 41 of the push rod 14 and of the linear drive 16. This stop surface 41 of the linear drive 17 is provided in a supporting plate 42 of the linear drive that can be pushed into the mounting element 18, whereas the stop surface of the push rod 14 is located on an elevation of the latter.

The locking device 28 according to FIGS. 14 to 20, which also acts automatically, functions in the same way as the locking device according to FIGS. 7 to 13.

Before inserting the linear drive 17 into the mounting element 18 the detents 47, 48 are pivoted into this mounting element 18. Upon drawing the linear drive into the mounting element the supporting plate 42 strikes the detent 48 with the stop surface 41 and pushes it out to such an extent that the detent 47 connected to it via the connecting rod 39 pivots out of the trajectory of the push rod 14. Therefore, the push rod 14 can move freely for as long as the linear drive 17 is inserted in the mounting element 18.

If the linear drive is drawn out of the mounting element 18, both detents 47, 48 can then pivot back with the result that the detent 47 then projects into the trajectory of the stroke limitation bolt 34 again. It is thus achieved that after the linear drive has been removed, the sliding closure does not open unintentionally during transport because the push rod 14 is then locked by the detent 47 in cooperation with the stop on the push rod.

As can be seen from the figures, the sliding closure according to FIGS. 2 to 6 is only equipped with one cylinder lock in the form of the locking device 21 for the linear drive 17. With the sliding closures according to FIGS. 7 to 17 and 14 to 20, instead of this the cylinder lock is combined with a transport lock in the form of the locking device 28 for the push rod 14. It is therefore possible within the framework of the invention to incorporate both locking devices individually or together into the locking closure, particularly as in the latter case their functions obviously complement one another.

Due to the design proposed for the latter, it is also possible, without a great deal of complexity, to incorporate the locking devices subsequently into existing sliding closures.

The invention claimed is:

1. A sliding closure for a vessel containing molten metal, comprising:

a slider housing;

a slider unit guided in said slider housing, said slider unit including a push rod;

a linear drive including a drive rod;

a coupling for connecting said push rod of said slider unit to said drive rod of said linear drive; and a mounting element for said linear drive situated on said slider housing, said mounting element receiving said push rod and said drive rod, said mounting element including an automatically operating locking device for said linear drive, said locking device including a locking rod that is parallel to an axis of said drive rod and coupled to said linear drive, and a locking catch attached to said mounting element, said locking rod cooperating with said locking catch to enable said linear drive to be locked to said mounting element via the cooperation between said locking rod and said locking catch.

2. The sliding closure of claim 1, wherein said drive rod includes a flange.

3. The sliding closure of claim 2, wherein said locking rod is attached to said flange.

4. The sliding closure of claim 2, wherein said coupling comprises a coupling part, said locking rod being attached to said flange in a region of said coupling part.

5. The sliding closure of claim 1, wherein said locking rod has a coupling side and a first recess on the coupling side.

6. The sliding closure of claim 5, wherein said locking catch engages with said first recess when said drive rod is drawn in and is releasable from said first recess.

7. The sliding closure of claim 6, wherein said locking rod has a second recess on an end facing away from the coupling side, said locking catch being releasable from said second recess when said drive rod is drawn out.

8. The sliding closure of claim 1, further comprising a bolt guided within said mounting element.

9. The sliding closure of claim 8, wherein said locking catch is mounted in said bolt laterally to said locking rod.

10. The sliding closure of claim 1, wherein said locking rod is aligned axially parallel to said drive rod.

11. The sliding closure of claim 1, wherein said locking catch includes two catch elements.

12. The sliding closure of claim 1, wherein said locking rod has two recesses each in a form of annular grooves that correspond to stroke end positions of said drive rod.

13. The sliding closure of claim 1, wherein said locking rod and said locking catch cooperate such that movement of said drive rod causes movement of said locking rod.

14. The sliding closure of claim 1, wherein said locking rod cooperates with said locking catch to prevent said drive rod from rotating.

15. The sliding closure of claim 1, wherein said locking rod includes grooves, said locking rod and said locking catch cooperate by said locking catch encompassing said locking rod in a region between said grooves.

16. The sliding closure of claim 1, wherein said mounting element has a coupling side, said mounting element receiving said drive rod and said push rod on the coupling side.

17. The sliding closure of claim 1, further comprising a push rod locking device for said push rod of said slider unit, said push rod locking device including a spring-loaded lever pivotably mounted in said mounting element, said lever including a tappet disposed close to a pivot axis and a blocking pin disposed on an end of said lever facing away from the pivot axis, said tappet and said blocking pin projecting into said mounting element and cooperating with a coupling part of said coupling and with a stop surface of said push rod.

18. The sliding closure of claim 17, wherein said stop surface of said push rod is formed by a stroke limitation bolt disposed laterally to a longitudinal axis of said push rod.

19. The sliding closure of claim 1, further comprising a push rod locking device for said push rod of said slider unit, said push rod locking device including two detents projecting into said mounting element, and a connecting rod that connects said detents to one another, said connecting rod being rotatably mounted in said mounting element and cooperating with a stop surface of said push rod and a stop surface of said linear drive.

20. The sliding closure of claim 19, wherein said stop surface of said linear drive is formed by a supporting plate of said linear drive that can be pushed into said mounting element and said stop surface of said push rod.

* * * * *